United States Patent [19]

Seaman

[11] Patent Number: 5,061,193

[45] Date of Patent: Oct. 29, 1991

[54] ELECTRICAL CONNECTION ARRANGEMENT AND METHOD OF PROVIDING AN ELECTRICAL CONNECTION

[75] Inventor: Robert B. Seaman, Nr. Cirencester, England

[73] Assignee: Lucas Industries PLC, Birmingham, England

[21] Appl. No.: 454,713

[22] Filed: Dec. 21, 1989

[30] Foreign Application Priority Data

Dec. 23, 1988 [GB] United Kingdom ..... 8830057

[51] Int. Cl.[5] ..... H01R 9/09

[52] U.S. Cl. ..... 439/76; 439/276; 439/620; 439/926

[58] Field of Search ..... 439/76, 201, 204, 276, 439/564, 620, 908, 926

[56] References Cited

U.S. PATENT DOCUMENTS

| | | | |
|---|---|---|---|
| 3,996,914 | 12/1976 | Crall et al. | 123/198 E |
| 4,723,196 | 2/1988 | Hofmeister et al. | 439/76 |
| 4,729,743 | 3/1988 | Farrar et al. | 439/276 |
| 4,800,732 | 1/1989 | Newton | 439/926 |
| 4,804,330 | 2/1989 | Makowski | 439/76 |

FOREIGN PATENT DOCUMENTS

| | | |
|---|---|---|
| 287703 | 10/1988 | European Pat. Off. . |
| 1515772 | 11/1969 | Fed. Rep. of Germany . |
| 3423316 | 1/1986 | Fed. Rep. of Germany . |
| 2147369 | 5/1985 | United Kingdom . |

*Primary Examiner*—Paula A. Bradley

*Attorney, Agent, or Firm*—Leydig, Voit & Mayer

[57] ABSTRACT

An electrical connection arrangement (20) provides an electrical connection between an electrical device (14) inside a vehicle engine casing (10) and an electrical termination (15) outside the casing. The connection arrangement comprises a PCB (21) which is sealed to an edge surface (21) of the casing around an opening (26) therein. The PCB bears a number of electrically conductive tracks (e.g. 22), one part (e.g. 22*a*) of each track being located inside the housing and being connected to the device (14) and another part (e.g. 22*b*) of each track being located outside the housing and being connected to a termination (15).

5 Claims, 1 Drawing Sheet

ELECTRICAL CONNECTION ARRANGEMENT AND METHOD OF PROVIDING AN ELECTRICAL CONNECTION

BACKGROUND OF THE INVENTION

The present invention relates to an electrical connection arrangement and to a method of providing an electrical connection, and the invention relates particularly to an arrangement and method for providing an electrical connection between a first connection site inside a casing and a second connection site outside the casing. The invention is particularly, though not exclusively, applicable to vehicle engine casings containing fluids, such as diesel fuel or oil.

With the increasing use in vehicles of engine management systems it has become customary to site electrical and electronic devices in the fluid environment inside the engine casing.

It is usually necessary to connect one or more of these devices to terminations outside the casing, and hitherto this has been achieved using one or more lead wires or cables which are routed through an opening formed in the casing wall. This approach has proved to be unsatisfactory since it i difficult to form an effective, fluid-tight seal to the emergent wires or cables, fluid tending to advance along the surface of the wires or cables by capillary action. This effect is exacerbated if the fluid Pressure inside the engine casing is even slightly higher than the ambient pressure outside, and this problem is particularly acute when the fluid inside the casing is diesel fuel.

It is an object of the present invention to provide an electrical connection arrangement which at least alleviates this problem.

BRIEF SUMMARY OF THE INVENTION

In accordance with one aspect of the invention there is provided an electrical connection arrangement providing an electrical connection between a first connection site inside the casing and a second connection site outside the casing, the electrical connection arrangement comprising, an electrically insulating substrate, an electrically conductive track formed on the electrically insulating substrate, one part of the track being situated inside the casing and being connected directly to the first connection site and another part of the track being situated outside the casing and being connected directly to the second connection site, the electrically insulating substrate and the electrically conductive track being sealed to the casing in a fluid-tight manner whereby to provide a fluid-tight seal between the one and another parts.

In accordance with another aspect of the invention there is provided a casing including an electrical connection arrangement providing an electrical connection between a first connection site inside the casing and a second connection site outside the casing, the electrical connection arrangement comprising an electrically insulating substrate, an electrically conductive track formed on the insulating substrate, one part of the track being situated inside the casing and being connected directly to the first connection site, and another part of the track being situated outside the casing and being connected directly to the second connection site, the electrically insulating substrate and the electrically conductive track being sealed to the casing in fluid-tight manner whereby to provide a fluid tight seal between the one and another parts of the track.

It will be understood that throughout this specification the word fluid embraces both liquids and gases.

The invention is applicable to a vehicle engine casing containing a fluid, such as diesel fuel or oil, and a connection site inside the casing may comprise a terminal of an electrical or electronic device disposed inside the casing.

The electrically insulating substrate may be sealed in fluid-tight manner to an edge surface of the casing around an opening therein and the electrically insulating substrate may bear more than one of said electrically conductive track, each said track being sealed, in fluid-tight manner, to the casing and forming part of an electrical connection between a respective first connection site inside the casing and a respective second connection site outside the casing.

Especially when the casing is a vehicle engine casing, the casing may comprise a first Part and a second part, each side of the substrate being sealed, in fluid-tight manner, to a respective said part of the casing. One of the parts of the casing may comprise a cover for the other part.

One or both sides of the substrate may bear one or more electrically conductive tracks, each track being electrically connected to a respective first connection site inside the casing.

The substrate is preferably sealed to the casing by sealing means in the form of a gasket or gaskets.

In accordance with further aspect of the invention there is provided a method of establishing an electrical connection between a first connection site inside a casing and a second connection site outside the casing, including the steps of providing an electrically insulating substrate bearing an electrically conductive track, sealing the substrate and the track to the casing in fluid-tight manner, whereby to provide a fluid-tight seal between one part of the track, which is situated inside the casing, and another part of the track, which is situated outside the casing, electrically connecting the first and second sites to one and another part of the track respectively.

BRIEF DESCRIPTION OF THE DRAWINGS

An embodiment of the invention will now be described, by way of example only, by reference to the accompanying drawings of which.

DESCRIPTION OF THE PREFERRED EMBODIMENT

Figure 1:
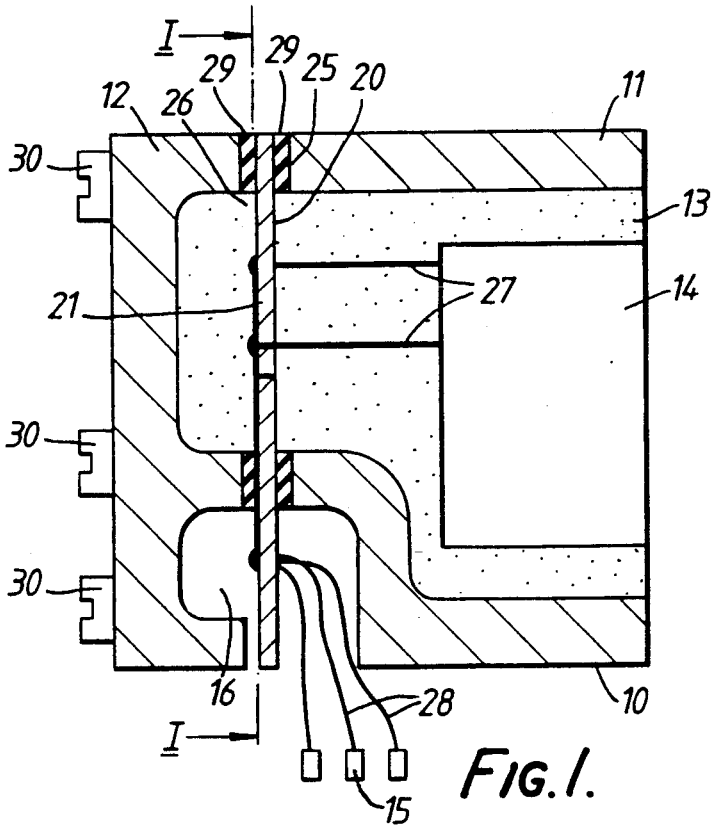
FIG. 1 shows a longitudinal, cross-sectional view of part of a vehicle engine casing incorporating an electrical connection arrangement in accordance with the present invention.

Referring now to FIG. 1 of the accompanying drawings, the engine casing 10 includes a main part 11 and a cover 12 which is fitted to the main part 11 in a manner which will be described in greater detail hereinafter.

In this example the interior of the casing is filled with diesel fuel (referenced as 13 in the drawing) and, as is increasingly the case in vehicle engine design, electrical and/or electronic devices dedicated to control and supervisory functions associated with engine management, are located inside the engine casing and are therefore immersed in the fuel. For clarity of illustration, such electrical and/or electronic devices are illustrated schematically in FIG. 1, as block 14.

It may be necessary to provide electrical connections between one or more of the devices inside the engine casing and one or more electrical connection sites outside the casing. These external connection sites may comprise the terminals of other, externally located circuitry or, as in this example, they may comprise electrical terminations represented in the drawing at 15. It is desirable that these electrical connections be implemented as straightforwardly as possible. However, it is also important that the connections be made without substantial leakage of fluid from the casing. With these two objectives in mind, the casing is provided with an electrical connection arrangement, shown generally at 20.

Figure 2:
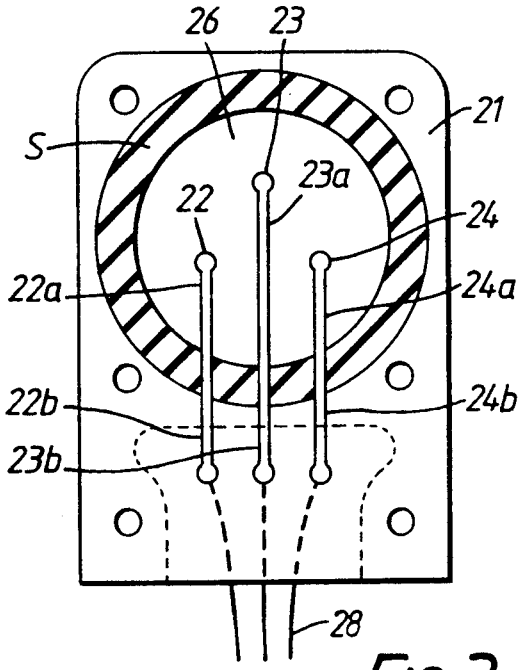
FIG. 2 shows an end-on view of the connection arrangement as viewed on line I—I in FIG. 1.

The electrical connection arrangement 20 comprises a printed circuit board (PCB) 21 and, as is shown more clearly in FIG. 2 of the drawings, the PCB bears a number (3 in this example) of electrically conductive tracks 22,23,24. These tracks may be formed on the PCB in a desired configuration using conventional photolithographic and deposition techniques. In this example, the PCB is sealed to an edge surface 25 of the casing around an opening 26 therein and each of the tracks extends from a region inside the casing to a region outside the casing, the PCB projecting into a wire-receiving recess 16 defined by the casing wall.

Parts *22a,23a,24a* of the tracks are situated inside the casing and each of these parts is electrically connected to an electrical device 14 by means of flexible cables or wires 27. Similarly, parts *22b,23b,24b* of the tracks are situated outside the casing and each of these parts is connected electrically to a respective termination 15 by means of suitable flexible cables or wires 28. In this manner, the electrical connection arrangement 20 provides three electrical connections between connection sites inside the housing and connection sites outside the housing. Clearly, it is possible to provide as many, or as few, electrical connections as desired by provision of an appropriate number of tracks on the PCB.

The PCB is sealed to the casing by means of a gasket 29 made of a suitable material having a desired compressibility and thickness, and the sealing area around opening 26 in the casing is represented by the shaded zone S in FIG. 2.

As shown in FIG. 1, a separate gasket 29 is provided to seal each part 11,12 of the casing to a respective side of the PCB and suitable fixing members 30, for example bolts or screws, are used to clamp the gaskets and the PCB between these parts thereby to achieve an effective and reliable seal. As will be clear from FIG. 2, each electrically conductive track crosses the sealing zone S, and since each track presents only a relatively shallow step at the surface of the PCB, the tracks are satisfactorily sealed to the edge surface 25, in a fluid-tight manner, overcoming many of the leakage problems associated with seals formed around wires and cables.

One or more electrically conductive tracks may be provided on each side of the PCB whereby electrical connections can be made to connection sites adjacent both sides thereof.

Alternatively, the cover part of the casing could be omitted altogether, the PCB being replaced by a suitably robust, electrically insulating substrate sealed to the casing to close off opening 26, this substrate bearing one or more electrically conductive tracks at the inwardly facing surface thereof. In these circumstances, a flat backing plate could be used to support the electrically insulating substrate.

It will be appreciated that although the invention has been described by reference to a vehicle engine casing, more specifically a casing for a diesel engine, the invention also embraces other applications wherein it is desired to establish one or more electrical connections, in a fluid-tight manner, between locations inside and outside a casing.

What I claim is:

1. A casing including an electrical connection arrangement providing an electrical connection between a first connection site inside the casing and a second connection side outside the casing, the electrical connection arrangement comprising an electrically insulating substrate, an electrically conductive track formed on the electrically insulating substrate, one part of the track being situated inside the casing and being connected directly to the first connection site, and another part of the track being situated outside the casing and being connected directly to the second connection site, the electrically insulating substrate and the electrically conductive track being sealed to the casing in fluid-tight manner whereby to provide a fluid-tight seal between said one and another parts of the track, and the casing comprising a first part and a second part, each side of the substrate being sealed, in fluid-tight manner, to a respective said part of the casing.

2. A casing as claimed in claim 1, wherein said second part is a cover for said first part.

3. A casing including an electrical connection arrangement providing an electrical connection between a first connection site inside the casing and a second connection site outside the casing, the electrical connection arrangement comprising an electrically insulating substrate, at least one electrically conductive track formed on each side of the electrically insulating substrate, one part of the at least one track on each said side being situated inside the casing and being connected directly to a respective said first connection site, and another part of the track being situated outside the casing and being connected directly to a respective said second connection site, the electrically insulating substrate and the at least one electrically conductive track on each said side of the substrate being sealed to the casing in fluid-tight manner whereby to provide a fluid-tight seal between said one and another parts of the track.

4. A casing including an electrical connection arrangement providing an electrical connection between a first connection site inside the casing and a second connection site outside the casing, the electrical connection arrangement comprising an electrically insulating substrate, an electrically conductive track formed on the electrically insulating substrate, one part of the track being situated inside the casing and being connected directly to the first connection site, and another part of the track being situated outside the casing and being connected directly to the second connection site, the electrically insulating substrate and the electrically conductive track being sealed to the casing in fluid-tight manner by at least one gasket whereby to provide a fluid-tight seal between said one and another parts of the track.

5. A vehicle engine casing including an electrical connection arrangement providing an electrical connection between a first connection site inside the casing and a second connection site outside the casing, the electrical connection arrangement comprising an electrically insulating substrate, an electrically conductive track formed on the electrically insulating substrate, one part of the track being situated inside the casing and being connected directly to the first connection site, and another part of the track being situated outside the casing and being connected directly to the second connection site, the electrically insulating substrate and the electrically conductive track being sealed to the casing in fluid-tight manner whereby to provide a fluid-tight seal between said one and another parts of the track.

* * * * *